United States Patent [19]

Lettrich

[11] Patent Number: 5,052,689

[45] Date of Patent: Oct. 1, 1991

[54] GOLF BALL AND GOLF TEE SUPPORT STRUCTURES

[76] Inventor: Kenneth P. Lettrich, 1802 Naglee Ave., San Jose, Calif. 95126

[21] Appl. No.: 556,888

[22] Filed: Jul. 23, 1990

[51] Int. Cl.[5] ..... A63B 69/36; A63B 57/00

[52] U.S. Cl. ..... 273/183 A; 273/202

[58] Field of Search ..... 273/183 A, 202, 203, 273/208, 195 R, 33, 204, 205, 206, 207, 208, 209, 210, 211, 212

[56] References Cited

U.S. PATENT DOCUMENTS

| | | | |
|---|---|---|---|
| 1,542,514 | 6/1925 | Mahony | 273/203 |
| 1,616,059 | 2/1927 | Mulvehill | 273/202 |
| 1,846,407 | 2/1932 | Thompson | 273/203 |
| 3,606,344 | 9/1971 | Ball | 273/202 |
| 3,690,676 | 9/1972 | Costa | 273/202 |
| 4,106,772 | 8/1978 | Krawagna | 273/183 A |
| 4,336,940 | 6/1982 | Sprague | 273/208 |

*Primary Examiner*—George J. Marlo
*Attorney, Agent, or Firm*—John J. Leavitt

[57] ABSTRACT

Presented is a golf ball and golf tee support structure that also limits the depth to which a tee may be inserted into the ground, thereby adjusting the elevation of the tee above the ground and providing a platform for the golf ball that is the proper elevation to meet the needs of the particular golfer. The structure includes a tubular support that accepts either a tee, or a ball without use of a tee, and which is provided with annular grooves around its outer periphery to facilitate cutting the tubular member to whatever height is best suited to the golfer. A flat ground engaging plate integral with one end of the tubular member restricts the depth to which a tee may be plunged into the ground. In a second aspect of the invention, sharpened prongs are provided on the underside of the flat plate that are adapted to be inserted into the ground when the device is set to aid in lateral stabilization of the device. To retain the device on the shank of a tee against inadvertent displacement, the inner periphery of the tubular member is provided with radially projecting and axially extending ribs that engage the outer periphery of the tee shank. Additionally, an elastically resilient annular bead is provided internally of the tubular member adjacent one end thereof to center and retain the shank of the tee.

14 Claims, 1 Drawing Sheet

GOLF BALL AND GOLF TEE SUPPORT STRUCTURES

BACKGROUND OF THE INVENTION

1. Field of the Invention

This invention relates to golf ball supporting structures, and particularly, in one aspect, to a tee support structure, and in another aspect, to a golf ball support structure apart from a conventional tee.

2. Description of the Prior Art

A preliminary patentability and novelty search in connection with this invention has revealed the existence of the following U.S. Pat. Nos.:

1,625,911
3,114,557
3,203,700
3,408,079
4,516,780

Referring to the patents listed above in the order of their issuance, U.S. Pat. No. 1,625,911 discloses a golf tee having a threaded shank, with an annular disk having internal threads engaging the threads of the shank. Rotation of the annular disk effects adjustment of the disk up or down, depending upon the height preferred by the golfer.

U.S. Pat. No. 3,114,557 provides a golf tee, the shank of which is provided with longitudinally extending lugs, while an annular collar is provided with notches extending radially outwardly from the central bore and adapted to be aligned with the lugs so as to permit the collar to be raised or lowered, at the discretion of the golfer, then turned to lock in position.

U.S. Pat. No. 3,203,700 discloses a tee the shank of which is provided with radially extending notches, and a metal clip adapted to be engaged with the notches at whatever height is desirable for the golfer. The function of establishing the height of the tee above the ground is provided by the clip being inserted in a selected pair of notches on the shank.

U.S. Pat. No. 3,408,079 relates to a golf tee having a vertically adjustable ground engaging stop member having a square hole adapted to slidably engage the square shank of the tee. To position the height adjustment member, corner portions of the shank are removed, permitting the annular plate to be adjusted vertically and then rotated to lock it in place along the shank.

U.S. Pat. No. 4,516,780 provides a golf tee formed of two coaxially arranged members, the upper and ball supporting member being slidably enaged in a longitudinal bore formed in the lower member, with the interengaging surfaces of the inner and outer member being such as to permit the upper member to be frictionally held in whatever position the golfer selects. The outer member having the golf ball supporting head is provided with a cross pin that penetrates a slot formed in the adjustable portion. This prevents complete separation of the two parts while permitting axial adjustment of one part in relation to the other.

It requires only a cursory examination of these prior art patents to know that the structures disclosed therein are vastly different from the structures forming the subject matter of my invention. To be accepted by golfers, devices of this type must be extremely simple, easy to use, provide consistency in use, and be inexpensive to purchase. Accordingly, one of the important objects of this invention is the provision of a golf ball supporting structure that meets all of these requirements.

Because of the population explosion, the dearth of golf courses in crowded metropolitan areas, and the increase in popularity of the game of golf, it is essential that golfers be motivated to play a round of golf in as short a time as possible so that more golfers may utilize a given course in a predetermined time frame. Accordingly, another object of the invention is the provision of a ball support structure, either directly or indirectly, that facilitates placement of a golf ball at the tee area, adjusts the height of the ball for the particular golfer, and thus speeds up the game to enable more golfers to play a course within a predetermined time frame.

One of the reasons golfers slice or hook a golf ball is an improper stance when addressing the ball. Accordingly, another object of the present invention is the provision of a golf ball supporting device that points the direction between the ball and the green to which it is being played so that the golfer may utilized this guide to correct his stance at the ball.

In the prior art discussed above, special construction parameters are disclosed for the tee. It is one of the important objects in connection with my invention that the ball support device may be utilized with a conventional tee to support the ball at the appropriate height for the golfer.

A still further object of the invention is the provision of a golf ball supporting structure, that may be adjusted in height to accommodate the needs of different golfers.

Not the least of the factors that promote longer drives is the confidence level of the golfer as he addresses the ball. One aspect of developing such confidence is knowing that the golf ball will be at precisely the right height each time the ball is to be addressed. Accordingly, another object of the invention is the provision of a golf ball support structure that a golfer may customized to suit his particular need regarding the height of the ball above the ground.

A still further object of the invention is the provision of a golf ball supporting device that supports a conventional tee substantially perpendicular to the ground.

The invention possesses other features of advantage, some of which, with the foregoing, will be apparent from the following description and the drawings. It is to be understood, however, that the invention is not limited to the embodiments illustrated and described, since they may be modified within the scope of the appended claims.

SUMMARY OF THE INVENTION

In terms of broad inclusion, in one aspect, my invention comprises a support structure for application to, and cooperation with, a conventional tee for supporting a golf ball at a selected height above the ground. In this aspect of the invention, the support device comprises a generally cylindrical tube having means for frictionally engaging the cylindrical shank of a conventional golf tee. Means are provided on the tee effective to adjust the length of the tube to control the height of the tee above the ground. Ground engaging means are also provided operatively associated with the tube forming a ground engaging member that limits penetration of the tee to thus control its height above the ground, and that also controls the verticality of the tee in relation to the ground. In a second aspect of the invention, the golf ball support device comprises a structure that substitutes for the conventional tee, and includes a cylindrical tubular member on the open top end of which the ball is perched, with the lower end of the tubular member engaging a flat plate perpendicular to the axis of the tubular member, and having sharpened prongs projecting from the side of the plate opposite the tubular member for anchoring the device in the ground.

DESCRIPTION OF THE PREFERRED EMBODIMENTS

Figure 6:
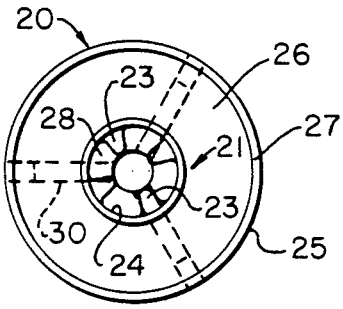
FIG. 6 is a plan view of a second embodiment of my golf ball support device which obviates the need of a conventional golf tee.
Figure 7:
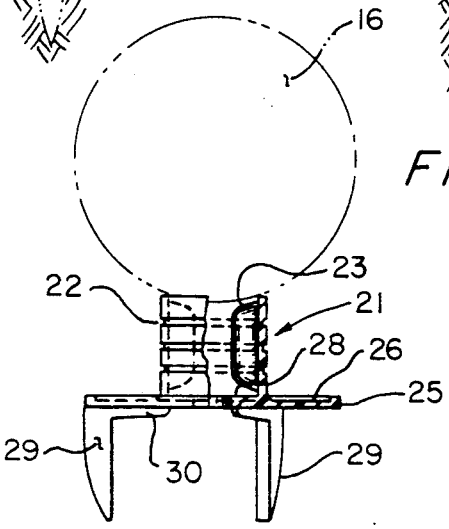
FIG. 7 is an elevational view of the golf ball support device of FIG. 6, portions of the structure being broken away to reveal the structure.

In terms of greater detail, the golf ball support device of my invention is illustrated and described in two different aspects. In one aspect, illustrated in FIGS. 1–5, inclusive, the golf ball support device is shown used in conjunction with a conventional golf tee. In a second aspect, the golf ball support device as illustrated in FIGS. 6 and 7, is not dependent upon a conventional golf tee, but rather substitutes for such a tee, while accomplishing the ultimate function of supporting the golf ball at a requisite elevation above the ground. Optionally, a tee may be used with this embodiment.

Referring first to the embodiment of FIGS. 1–5, inclusive, the golf ball support device is designated generally by the numeral 2, and includes an elongated generally cylindrical tubular member symmetrical about a longitudinal axis 3 and generally designated by the numeral 4.

The tubular member 4 is proportioned to accept the passage of a conventional tee 5 therethrough as shown, and is provided at its lower end with a radially extending annular ground engaging plate 6, having a top surface 7 visible to the golfer, and having indicia 8 visible on the top surface, the indicia constituting a line formed either by printing, embossing or molding, and extending radially from the axis 3 outwardly toward the periphery of the plate.

Formed in the outer cylindrical surface of the tubular member 4 are a multiplicity of annular grooves 9 spaced apart about ⅛", and having a depth such that the remaining thickness of the wall of the tubular member may be easily cut with a knife or other sharp blade to shorten the height of the tubular member in relation to the plate 6.

To snugly and frictionally engage the smooth cylindrical shank 10 of the tee 5, the inner periphery 12 of the tubular member 4 is provided with longitudinally extending circumferentially spaced integral ribs 13. The proportions of the ribs is such that the cylindrical shank of the tee engages the crowns of the ribs, slightly compressing the ribs along their length, and thus resulting in the tee and the support device being frictionally held in assembled relationship without concern that they will separate, or that they will change their relationship in any way. Additionally, to make certain that the support device 2 and tee 5 will not inadvertently separate or change their positions in relation to one another, there is provided an annular bead 14 on the inner periphery 12 of the tubular member adjacent the location of the annular plate 6 as shown best in FIG. 3. The support device 2 is preferably formed by injection molding of an appropriate synthetic resinous material that has a slight amount of elastic resilience so that when the tee is inserted through the bore 12, the annular bead will be expanded slightly to firmly and resiliently engage the outer cylindrical periphery of the tee.

Figure 4:
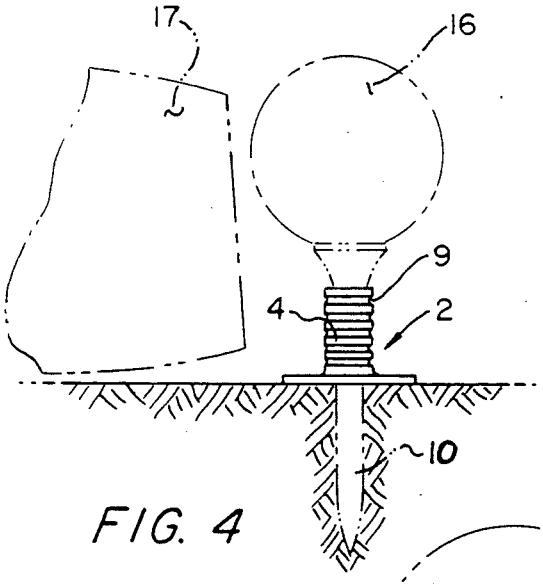
FIG. 4 is an elevational view substantially actual size of the golf ball support device applied to a conventional golf tee, shown in relation to the face of a golf club head.
Figure 5:
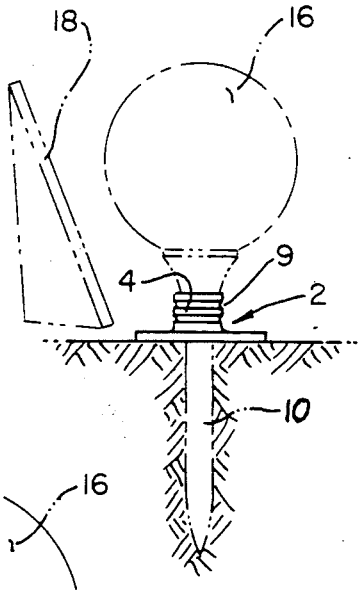
FIG. 5 is an elevational view similar to FIG. 4 but showing the height of the ball support device of the invention modified to accommodate the higher loft angle of an "iron" club.

Referring to FIGS. 4 and 5, it will there be seen that the golf ball support device 2 as illustrated in FIG. 4 is at its maximum height, supporting the ball 16 at an elevation that is consistent with the lower angle of loft on the face of a driver having a wood head 17. In contrast, the support device 2 as illustrated in FIG. 5 has been cut down to about half the height of the tubular member in FIG. 4, resulting in the elevation of the ball being consistent with the larger loft angle desireable on a golf club having an "iron" head 18.

Again referring to FIGS. 4 and 5, it will be seen that the golf ball support device of either height is pushed onto the cylindrical shank of the tee until the top of the tubular member engages the outwardly conically curving surface of the shank immediately below the head of the tee. Thus, the tee may be pushed vigorously into the ground, but will not penetrate beyond the depth controlled by engagement of the annular plate 6 with the surface of the ground. In this position, it should be noted that without my ball and tee support structure, the conventional tee frequently breaks in the area between the head and the surface of the ground when hit by the face of the club. I have found that when my support structure is placed on the tee as indicated in FIGS. 4 and 5, there is much less tendency for the tee to break in this area for the reason that the shank of the tee is reinforced in this area by the surrounding tubular member.

The embodiment of the golf ball support structure or device illustrated in FIGS. 6 and 7 differs somewhat in structure from the embodiment illustrated in FIGS. 1–5, but in many respects is similar. Thus, referring to FIG. 6, the embodiment of my ball support structure illustrated here is designated generally by the numeral 20. The support structure comprises a cylindrical tubular member 21 formed with annular grooves 22 spaced longitudinally along the outer periphery similarly to the grooves 9 in the tubular member 4 of FIGS. 1–5, and having longitudinally extending ribs 23 formed on the inner periphery 24 of the tubular member and spaced circumferentially thereabout.

Formed integrally on the lower end of the tubular member is an annular ground engaging plate 25, preferably, but not necessarily, circular in its configuration and having a top annular surface 26 recessed below a peripheral rim 27. The recessed annular area surrounds the tubular member and provides for the application of appropriate advertising material or the placement of an annular seal (not shown) on which indicia similar in nature and functionn to the indicia 8 of FIG. 2 may be carried.

Figure 1:
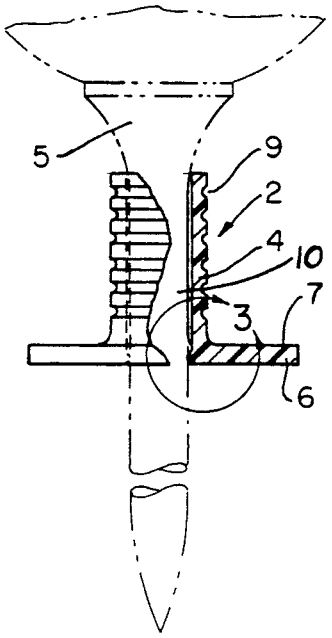
FIG. 1 is an elevational view partly in vertical section illustrating my golf ball support device in relation to a conventional golf tee on which a golf ball is supported.
Figure 2:
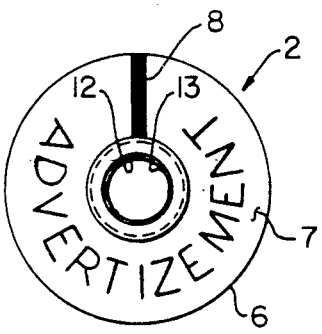
FIG. 2 is a top plan view of the golf ball support device of FIG. 1 apart from the tee.
Figure 3:
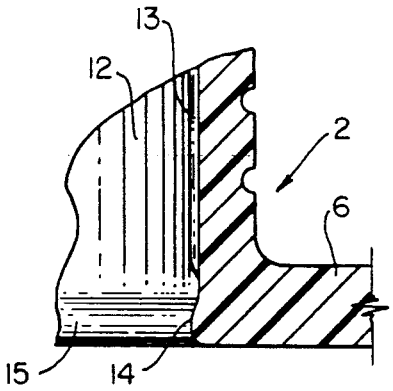
FIG. 3 is an enlarged fragmentary sectional view of that portion of the support device illustrated in FIG. 1 that is enclosed within the area indicated by the arrow 3.

To increase the versatility of the support device or structure of FIGS. 6 and 7, the lower end of the tubular member 21 is preferably integral with the annular ground engaging plate 25 in the same way that the plate 6 of the embodiment of FIG. 1 is integral with the tubular member 4. In like manner, there is provided adjacent the annular plate 25, within the inner periphery 24, an elastically resilient annular bead 28 that, optionally, serves the same purpose as the bead 14 in the embodiment of the invention illustrated in FIGS. 1–5.

To lend greater stability to the golf ball support structure of the invention, the embodiment illustrated in FIGS. 6 and 7 is provided with a plurality of downwardly extending integral and sharpened prongs 29 which are adapted to penetrate the ground when the support device is pressed downwardly to set it in position to receive a golf ball. The prongs thus provide lateral stability to the ball-supporting platform provided by the upwardly extending open end of the tubular member 21, on which the golf ball may be supported directly as indicated. It should be noted that to lend rigidity and strength to the downwardly extending prongs, each is reinforced with a radially inwardly extending rib 30 that is integral with the rib and integral also with the underside of the ground engaging plate 25.

For even greater versatility, the embodiment of the invention illustrated in FIGS. 6 and 7 may be used with a conventional tee merely by inserting the tee through the tubular member in the same manner in which the tee 5 is inserted through the tubular member 2. In this case, however, since the diameter of the tubular member 21 is substantially larger then the diameter of the tubular member 2 so that a larger spherical area of the directly supported golf ball is in contact with the upper rim of the tubular member, the ribs 23 are recessed below the upper rim of the tubular member and project radially inwardly a distance sufficient so that the crowns may be engaged by the outer cylindrical periphery of a conventional tee. Thus, this embodiment may be utilized in the same way as the embodiment of FIGS. 1–5, the grooves enabling cutting of the tubular member to lessen its height to thus control the elevation of the ball above the ground.

Having thus described the invention, what is believed to be new and novel and sought to be protected by letters patent of the United States is as follows;

I claim:

1. In combination, a golf tee and support therefor, said support for use in cooperation with said golf tee, said golf tee having a cylindrical shank pointed at one end and diverging conically into a golf ball support head at the opposite end, said support comprising:

a) an annular base member adapted to frictionally engage the cylindrical shank of said tee extending therethrough and to rest on the ground below a golf ball supported on said golf ball support head elevated a predetermined distance above the ground in position to be hit by a golf club; and b) a tubular member of less diameter than said base member, centrally disposed on said base member and adapted to frictionally engage a portion of said cylindrical tee shank and extending upwardly from said base member to maintain said tee head at said predetermined elevation above the ground to aid in supporting a golf ball consistently at said predetermined elevated position above the ground.

2. The device according to claim 1, wherein said base member is a flat annular plate having an aperture symmetrical about a central axis and said tubular member extends coaxially from one side thereof.

3. The device according to claim 1, wherein said tubular member is integral with said base member.

4. The device according to claim 1, wherein annular grooves are provided axially spaced along the outer periphery of said tubular member.

5. The device according to claim 1, wherein said base member includes an annular upper surface surrounding said tubular member, and indicia means are provided on said annular surface adjustable to indicate a straight line between the device and the green to which a golf ball is to be played.

6. The device according to claim 1, wherein said tubular member is open at opposite ends.

7. The device according to claim 1, wherein a plurality of axially extending elongated rib members are provided on the inner periphery of said tubular member.

8. The device according to claim 1, wherein an annular bead is provided on the inner periphery of said annular base member and adapted to frictionally engage said cylindrical shank when the tee is inserted therethrough.

9. The device according to claim 1, wherein a plurality of prongs are provided on the side of said base member opposite said tubular member whereby said prongs may be embedded in the ground to stabalized the device.

10. The device according to claim 9, wherein said prongs are integral with said base member and circumferentially spaced adjacent the outer periphery of the base member.

11. The device according to claim 10, wherein said base member includes an annular upper surface surrounding said tubular member, and indicia means are provided on said annular upper surface adjustable to indicate a selected direction in which a golf ball is to be driven.

12. The device according to claim 11, wherein a series of annular grooves are axially spaced along the outer periphery of said tubular member.

13. The device according to claim 11, wherein a plurality of axially extending elongated rib members are provided on the inner periphery of said tubular member.

14. The device according to claims 1, 2, 3, 4, 5, 6, 7, 8, 9, 10, 11, 12 or 13, wherein said article of manufacture is formed from synthetic resinous material having the quality of resilience.

* * * * *